US008393293B2

(12) United States Patent
Kawashita et al.

(10) Patent No.: US 8,393,293 B2
(45) Date of Patent: Mar. 12, 2013

(54) METHOD FOR TREATING WEB, TREATMENT TANK, CONTINUOUS ELECTROPLATING APPARATUS, AND METHOD FOR PRODUCING PLATING FILM-COATED PLASTIC FILM

(75) Inventors: Mamoru Kawashita, Otsu (JP); Fumiyasu Nomura, Otsu (JP)

(73) Assignees: Toray Industries, Inc., Tokyo (JP); Toray Advanced Film Co., Ltd., Tokyo (JP)

( * ) Notice: Subject to any disclaimer, the term of this patent is extended or adjusted under 35 U.S.C. 154(b) by 294 days.

(21) Appl. No.: 12/676,074

(22) PCT Filed: Sep. 2, 2008

(86) PCT No.: PCT/JP2008/065702

§ 371 (c)(1), (2), (4) Date: Mar. 2, 2010

(87) PCT Pub. No.: WO2009/031508

PCT Pub. Date: Mar. 12, 2009

(65) Prior Publication Data

US 2010/0203252 A1 Aug. 12, 2010

(30) Foreign Application Priority Data

Sep. 6, 2007 (JP) ..... 2007-231150

(51) Int. Cl.
*B05C 3/12* (2006.01)

(52) U.S. Cl. ..... 118/429; 118/400; 118/423

(58) Field of Classification Search ..... 427/430.1, 427/435, 436; 118/400, 423, 428
See application file for complete search history.

(56) References Cited

U.S. PATENT DOCUMENTS

| | | | | |
|---|---|---|---|---|
| 2,522,071 | A * | 9/1950 | Tait | 134/122 R |
| 3,255,617 | A * | 6/1966 | Bisang | 68/175 |
| 4,162,955 | A * | 7/1979 | Schregenberger | 204/624 |

FOREIGN PATENT DOCUMENTS

| | | | |
|---|---|---|---|
| JP | 58-174263 | A | 10/1983 |
| JP | 58174263 | A * | 10/1983 |
| JP | 08277493 | A * | 10/1996 |
| JP | A 9-263980 | | 10/1997 |
| JP | 10-102287 | A | 4/1998 |
| JP | 11256393 | A * | 9/1999 |
| JP | A 11-256363 | | 9/1999 |
| JP | 2003147582 | A * | 5/2003 |
| JP | A 2003-147582 | | 5/2003 |
| JP | 2004-270003 | A | 9/2004 |
| JP | 2006-257454 | A | 9/2006 |
| JP | 2006-336082 | A | 12/2006 |

OTHER PUBLICATIONS

International Search Report dated Oct. 14, 2008, application No. PCT/JP2008/065702.

* cited by examiner

*Primary Examiner* — David Turocy
(74) *Attorney, Agent, or Firm* — RatnerPrestia

(57) ABSTRACT

A treatment tank is used which has a non-contact type liquid sealing unit capable of controlling liquid leakage in non-contact with a web.

5 Claims, 10 Drawing Sheets

PRIOR ART

PRIOR ART

PRIOR ART

A form of R part of embodiment 1

METHOD FOR TREATING WEB, TREATMENT TANK, CONTINUOUS ELECTROPLATING APPARATUS, AND METHOD FOR PRODUCING PLATING FILM-COATED PLASTIC FILM

This application is a U.S. National Phase Application of PCT International Application No. PCT/JP2008/065702, filed Sep. 2, 2008, which claims priority to Japanese Patent Application No. 2007-231150, filed Sep. 6, 2007, the content of these applications being incorporated by reference herein in their entirety.

FIELD OF THE INVENTION

The invention relates to a method for treating a web, a treatment tank, a continuous electroplating apparatus, and a plating film-coated plastic film.

BACKGROUND OF THE INVENTION

An apparatus for performing a treatment with a treatment liquid on a web being continuously fed includes a plurality of plating tanks each holding a plating liquid as the treatment liquid, through which a plastic film is allowed to sequentially pass, so that the desired plating treatment is performed on the surface of the plastic film being continuously fed. In such a web treatment apparatus, for example, slit-shaped inlet and outlet for the feed of the web are provided in each plating tank. In general, such a web treatment apparatus is provided with a liquid seal to prevent leakage of a large amount of the plating liquid from the tank to the outside.

FIG. 1 shows an example of such an apparatus in which copper (Cu) plating is performed on a plastic film (such as a polyimide film, hereinafter, plastic film is simply referred to as "film") as a base material. FIG. 1 is a plan view schematically showing the general structure of a film treatment apparatus. A film 1 being fed from an unwinding unit 2 in the film feed direction is energized by a power supply unit 3 (energizing step) and then subjected to a plating treatment in a plating unit 5 having a plating tank 4 (plating step). The energizing step and the plating step are sequentially repeated twice or more, so that a plating layer with a desired thickness is formed. After a desired plating layer is formed, the film is taken up by a take-up unit 6. For example, as shown in FIG. 2, the power supply unit 3 includes a feed roll 11 (for example, with a stainless steel (SUS) surface), another feed roll 12 (for example, with a stainless steel surface), and a power supply roll 13 (for example, with a cupper surface) that are placed between the feed rolls 11 and 12 so as to press the film 1 and energize the surface 10 of the film 1 to be plated. As shown in FIG. 3, for example, the plating unit 5 includes a plating tank 4 holding a plating liquid 14 (such as a copper sulfate solution) and copper blocks 15, through which the film 1 is allowed to continuously pass. In general, liquid sealing mechanisms are provided at the inlet and outlet of the plating tank 4 in order to control the amount of leakage of the plating liquid 14 from the plating tank 4 to the outside. It is known that as shown in FIG. 3, a pair of liquid sealing rolls 7 is used in the liquid sealing mechanism (see for example Patent Literature 1). In the film treatment apparatus shown in FIG. 1, the film 1 is fed from the unwinding unit 2 to the take-up unit 6, while the direction of its width is substantially oriented and held in the vertical direction so that good handleability and plating uniformity can be ensured (hereinafter, such feeding of the film with its width direction held in a substantially vertical direction is referred to as "vertically-oriented feed").

Conventionally, a mechanism as shown in FIG. 4, which is disclosed in Patent Literature 1, is used to ensure the liquid sealing capability at the inlet and outlet of a plating tank 4 as the treatment tank. Specifically, at the inlet and/or outlet of a plating tank 4 filled with a plating liquid 14, a small chamber 31 is formed along the inner wall surface of the plating tank 4 or outside the inlet and/or outlet as shown in FIG. 4, and two (a pair of) spongy-surface rolls 21 are provided inside the outer wall surface 25 of the small chamber 31. The film 1 being fed is nipped between the two spongy rolls 21, and the spongy rolls 21 are placed adjacent to the wall surface A (25) so that the liquid can be sealed therein (a relatively large gap is formed between the roll and the wall surface B (26)). In this case, the clearance between the rolls 21 is fixed. In FIG. 4, the wall surfaces A and B correspond to the surfaces from which the leader lines are drawn. In this method, however, foreign matter may be caught between the web and the liquid sealing roll to form scratches or dents on the surface of the web or to produce wrinkles, uneven tension or other problems.

In order to avoid such problems, there is proposed a method of controlling liquid leakage in non-contact with a web. Patent Literature 2 discloses a method in which the distance between a pair of liquid sealing rolls is made larger than the thickness of a web so that liquid leakage can be controlled in a non-contact manner. This method makes it possible to solve various problems caused by the contact of the liquid sealing roll. In this method, however, when the distance between the rolls is made large, due to the large amount of leakage the capacity of the system for circulating the treatment liquid needs to be increased to an unnecessarily high level. In addition, when the web to be treated is a flexible web such as a resin film, a relatively large amount of the liquid leaks, which causes the problem of fluttering of the web. If the fluttering is severe, the web may come into contact with the roll so that the web surface may be scratched. On the other hand, the distance between the rolls may be reduced so that the leakage amount can be reduced. In this case, however, the space between the roll and the web may be so narrow that the web may come into contact with the roll and be scratched, even when the feed of the web is slightly disturbed. This tendency becomes more remarkable as the web becomes more flexible.

Patent Literature 3 also discloses a technique to control liquid leakage in a similar non-contact manner. The method disclosed in Patent Literature 3 includes providing a plate for preventing leakage of a plating liquid, in which the plate has a rectangular slit which is placed at the opening of a plating tank so that the plate can be prevented from coming into contact with a web (steel tape) and through which the steel tape is allowed to pass (the plate is provided in a direction perpendicular to the steel tape feed direction). It is disclosed that the gap of the slit of the plating liquid leakage-preventing plate is determined taking into account the maximum thickness of the steel tape to be plated and a margin that makes it possible to feed the steel tape without any contact with the slit portion even when the steel tape flutters or becomes defective in shape during the feeding. In other words, this technical idea is to determine the gap of the slit depending on fluttering or defective shape of the steel tape being fed but not to use the gap of the slit to reduce fluttering or the like of the steel tape being fed. Patent Literature 3 also discloses examples in which the thickness of the plating liquid leakage-preventing plate (the length of the steel tape in the steel tape feed direction) is 10 mm or 8 mm, when it is made of a synthetic resin or a metal plate, respectively. As described in the examples, the plating liquid leakage-preventing plate has a dimension of 2,200 mm (length)×400 mm (width), and therefore, it is long and slim. Therefore, it is considered that the thickness of the plate is changed depending on the material it is made of so that the desired stiffness can be imparted to the plate. However, such a technique has the same problem as the technique disclosed in Patent Literature 2, in which when the slit gap of the plating liquid leakage-preventing plate is wide, the amount of leakage becomes large, and when the gap is narrow, the web comes into contact with the plating liquid leakage-preventing plate so that it is scratched. Therefore, it is very difficult to apply the technique to an apparatus for treating a flexible web.

Patent Literature 1: Japanese Patent Application Laid-Open (JP-A) No. 2003-147582

Patent Literature 2: JP-A No. 09-263980

Patent Literature 3: JP-A No. 11-256393

SUMMARY OF THE INVENTION

The invention provides a web treatment method, a treatment tank, and an electroplating apparatus, each of which makes it possible to control the amount of leakage regardless of how flexible the web is and to prevent contact-induced surface defects such as scratches.

The features of the invention are described below according to different embodiments.

According to an embodiment of the invention, there is provided a method for treating a web with a liquid chemical, including allowing the web to pass continuously through a treatment liquid placed in a treatment tank having a side wall, an opening provided in the side wall to serve as an inlet or outlet for the web, and a liquid sealing unit that is provided at the side wall to control leakage of the treatment liquid from the opening, the liquid sealing unit including a pair of wall surfaces spaced apart from each other with a predetermined gap therebetween and opposed to each other with the web passing therebetween, the pair of wall surfaces each having a length in the direction of feed of the web, the length being from 5% to 100% of the length of a slit in the direction of the depth of the treatment tank, the slit being formed by the pair of wall surfaces.

According to a preferred embodiment of the invention, there is provided a method for treating a web, wherein the amount of the treatment liquid leaking from the liquid sealing unit is from 5 L/minute to 300 L/minute per one liquid sealing unit.

According to another embodiment of the invention, there is provided a web treatment tank, including: a side wall; an opening provided in the side wall; and a liquid sealing unit that is provided at the side wall to control leakage of a treatment liquid from the opening, the liquid sealing unit including a pair of wall surfaces spaced apart from each other with a predetermined gap therebetween and opposed to each other with a web feed path interposed therebetween, the pair of wall surfaces each having a length in the direction of feed of the web, the length being from 5% to 100% of the length of a slit in the direction of the depth of the treatment tank, the slit being formed by the pair of wall surfaces.

According to a preferred embodiment of the invention, there is provided a web treatment tank, wherein the gap between the pair of wall surfaces over the direction of feed of the web has an average of 0.25 mm to 10 mm.

According to a preferred embodiment of the invention, there is provided a web treatment tank, wherein the wall surfaces provided with the predetermined gap therebetween include flat surfaces opposed to each other with the web feed path interposed therebetween.

According to a preferred embodiment of the invention, there is provided a web treatment tank, wherein the gap between the flat surfaces in the normal direction is from 0.25 mm to 10 mm.

According to a preferred embodiment of the invention, there is provided a web treatment tank, wherein the amount of the treatment liquid leaking from the liquid sealing unit satisfies formula 1:

$$300 \geqq \frac{\rho \times g \times C^3 \times H \times H'}{24 \times \eta \times L}$$

wherein ρ is the density (kg/re) of the treatment liquid, η is the viscosity (Pa·sec) of the treatment liquid, g is the gravitational acceleration (m/sec$^2$), C is the gap between the wall surfaces, L is the length (m) of the wall surface in the direction of feed of the web, H is the length (m) of the wall surface in the depth direction, and H' is the distance (m) from a lower end of the wall surface in the depth direction to the surface of the liquid.

According to a preferred embodiment of the invention, there is provided a web treatment tank, wherein the gap between the wall surfaces is narrower on its lower side than on its upper side.

According to a preferred embodiment of the invention, there is provided a web treatment tank, wherein the length of each wall surface in the direction of feed of the web is longer on its lower side than on its upper side.

According to a preferred embodiment of the invention, there is provided an apparatus for continuous electroplating on a web, including a plurality of plating treatment tanks through which a plastic film with one side or both sides pre-coated with an electrically-conductive thin film is allowed to continuously pass so that electroplating can be performed thereon, wherein at least one of the plating treatment tanks includes the above treatment tank.

According to another embodiment of the invention, there is provided a method for producing a plastic film coated with a plating film, including: performing a plating process using a plastic film as a web; and performing at least part of the plating process using any of the treatment methods stated above or using any of the treatment tanks stated above.

As used herein, the term "web" refers to a material having a sufficiently small thickness and a sufficiently long length relative to its width, such as a paper sheet, a resin film, or a metal foil. When a resin film or a paper web is used, the effects of the invention are particularly significant. The resin film is preferably made of a polyimide resin or a polyester resin. In the process of forming a copper-plated film for use as an electronic circuit material or the like, a general-purpose polyester film is preferably used. For soldering heat resistance in integrated circuit (IC) mounting or the like, a polyimide resin is preferably used.

As used herein, the term "wall surface" refers to a surface having a certain area. For example, a flat surface, a curved surface, and a grooved flat surface are encompassed by the category of "wall surface."

As used herein, the term "flat surface" encompassed by the wall surface refers to a surface having a flatness of 1 mm or less according to JIS B 0021 (1998).

As used herein, the "average" may be determined by dividing the length of the wall surface in the web feed direction into 20 equal parts, measuring the gap between the wall surfaces at each of the 20 points, and calculating the average of the measurements.

According to an embodiment of the invention, a web treatment method is provided which makes it possible to input and output a web into and from a treatment tank through liquid sealing units substantially in a non-contact matter, so that surface defects such as contact scratches are prevented.

According to another embodiment of the invention, there is provided a treatment tank that includes wall surfaces opposed to each other with a web feed path interposed therebetween, so that the frictional resistance between the wall surface and the treatment liquid can produce flow channel resistance, which makes it possible to keep the web substantially in a non-contact state and to control the amount of leakage. In addition, each structural component of the liquid sealing unit is substantially not in contact with the web, so that contact-induced degradation or the like is less likely to occur and that the performance can be maintained for a very long time. Therefore, a periodic part replacement or maintenance can be made unnecessary, and an increase in the part replacement cost, an operating rate reduction associated with suspension of the treatment, or the like is less likely to occur.

According to a preferred embodiment of the invention, two flat surfaces are opposed with a web feed path interposed therebetween, and the space between the two flat surfaces is used as a treatment liquid flow channel. In this structure, unstable pressure distribution is less likely to occur, so that a feed disturbance caused by fluttering of the web or the like can be suppressed.

According to a preferred embodiment of the invention, the amount of leakage from the liquid sealing unit can be controlled to be small, so that the treatment volume of the treatment liquid-circulating system can be designed to be small, which contributes to a reduction in cost.

A continuous electroplating apparatus generally has a plurality of treatment tanks and therefore significantly benefits from the cost reduction effect according to the invention. In a continuous electroplating apparatus, it is also possible to make the most of the advantage that various contact-induced surface defects are not produced because of no contact with the web.

DESCRIPTION OF REFERENCE CHARACTERS

Figure 1:
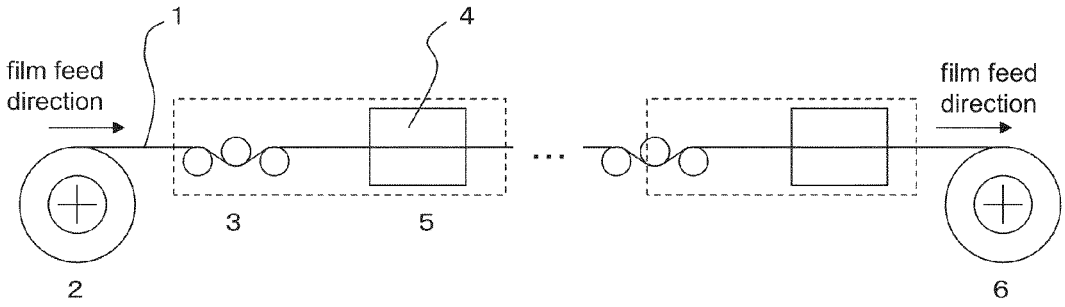
FIG. 1 is a schematic plan view of an apparatus for plating on a film, to which the invention is applicable.

In the drawings, reference character 1 represents a film, 2 an unwinding unit, 3 a power supply unit, 4 a plating tank as a treatment tank, 5 a plating unit, 6 a take-up unit, 7 a seal roll, 10 a surface to be plated, 11 and 12 a feed roll, 13 a power supply roll, 14 a plating liquid as a treatment liquid, 15 a copper block, 16 a collecting zone, 21 a spongy roll, 22 a base material, 24 a small chamber, 25 a wall surface A, 26 a wall surface B, 27 a wall surface C, 28*a* and 28*b* a slit, 29*a* and 29*b* a flow control member, 30 a treatment liquid leaking from the liquid sealing unit, 31 a small chamber, 32 an opening, and θ the angle between the tangent line on point A and the film feed direction.

DETAILED DESCRIPTION OF THE INVENTION

Embodiments of the invention are described below with reference to the drawings showing illustrative cases where a polyimide film (hereinafter simply referred to as "film"), which corresponds to the web, is used in a treatment tank of a vertically-oriented feed type continuous copper electroplating apparatus.

Figure 2:
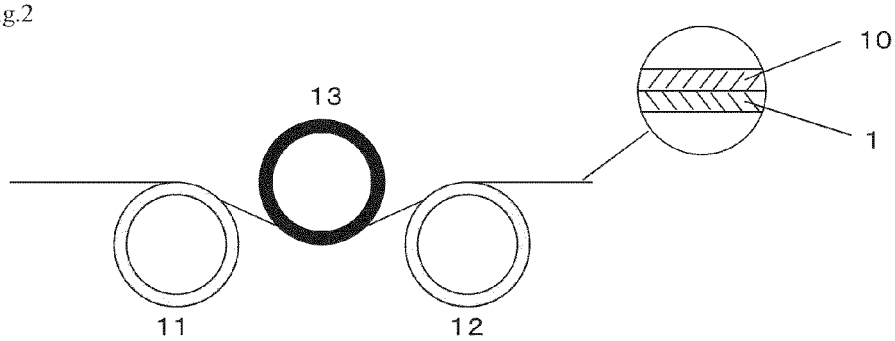
PRIOR ART fig.2
FIG. 2 is an enlarged plan view of the power supply unit of the apparatus shown in FIG. 1.
Figure 3:
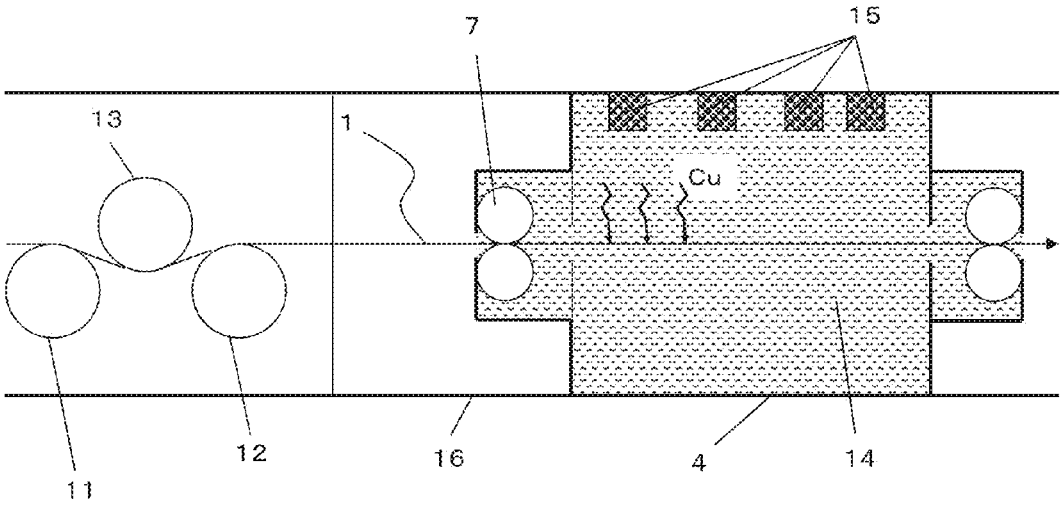
FIG. 3 is a schematic enlarged transverse cross-sectional view of a conventional plating unit for the apparatus shown in FIG. 1.
Figure 5:
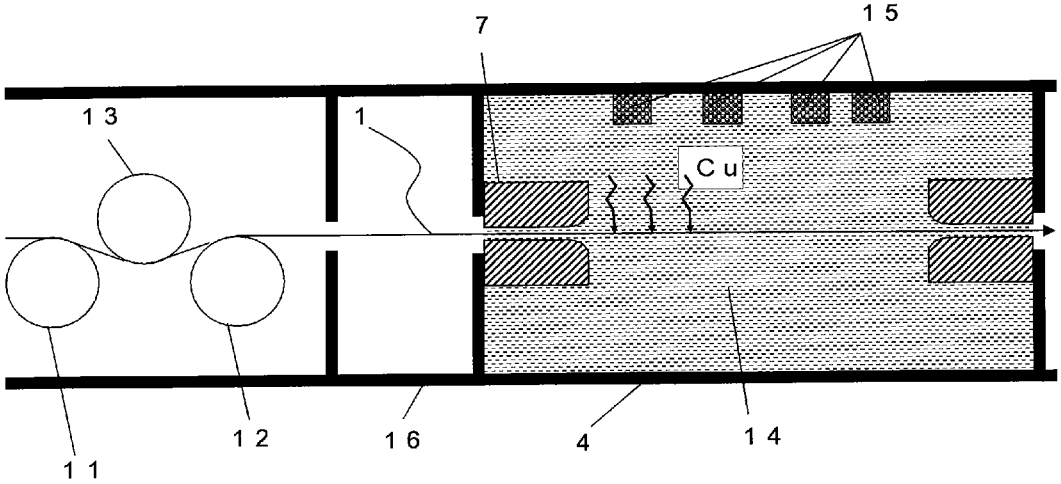
FIG. 5 is a schematic enlarged transverse cross-sectional view of the plating unit of an apparatus for plating on a web according to an embodiment of the invention.

FIG. 1 is a schematic plan view of an apparatus for plating on a film, which is applicable to the invention. A film 1 being fed from an unwinding unit 2 in the film feed direction is energized by a power supply unit 3 (energizing step) and then subjected to a plating treatment in a plating unit 5 having a plating tank 4 (plating step). The energizing step and the plating step are sequentially repeated twice or more, so that a plating layer with a desired thickness is formed. After a desired plating layer is formed, the film is taken up by a take-up unit 6. For example, as shown in FIG. 2, the power supply unit 3 includes a feed roll 11 (for example, with a stainless steel (SUS) surface), another feed roll 12 (for example, with a stainless steel surface), and a power supply roll 13 (for example, with a cupper surface) that is placed between the feed rolls 11 and 12 so as to press the film 1 and energize the surface 10 of the film 1 to be plated. FIG. 5 is a schematic enlarged transverse cross-sectional view of a plating unit of an apparatus for plating on a film according to an embodiment of the invention. As shown in FIG. 5, the film 1 in the plating unit 5 shown in FIG. 1 is allowed to pass continuously through the plating tank 4 that holds a plating liquid 14 and copper blocks 15. To control the amount of leakage of the plating liquid 14 from the plating tank 4 to the outside, liquid sealing units 7 are provided at the inlet and outlet of the plating tank 4, respectively. The liquid sealing units 7 are provided adjacent to the side walls at the inlet and outlet of the plating tank 4 and structured so that the plating liquid 14 hardly leaks between the liquid sealing unit 7 and the side wall of the plating tank 4. A seal member may or may not be provided between the liquid sealing unit 7 and the side wall of the plating tank 4 to prevent leakage therebetween. If the leakage therebetween is such a level that the feeding of the film is not affected, there is no need to provide a seal member.

Figure 6A:
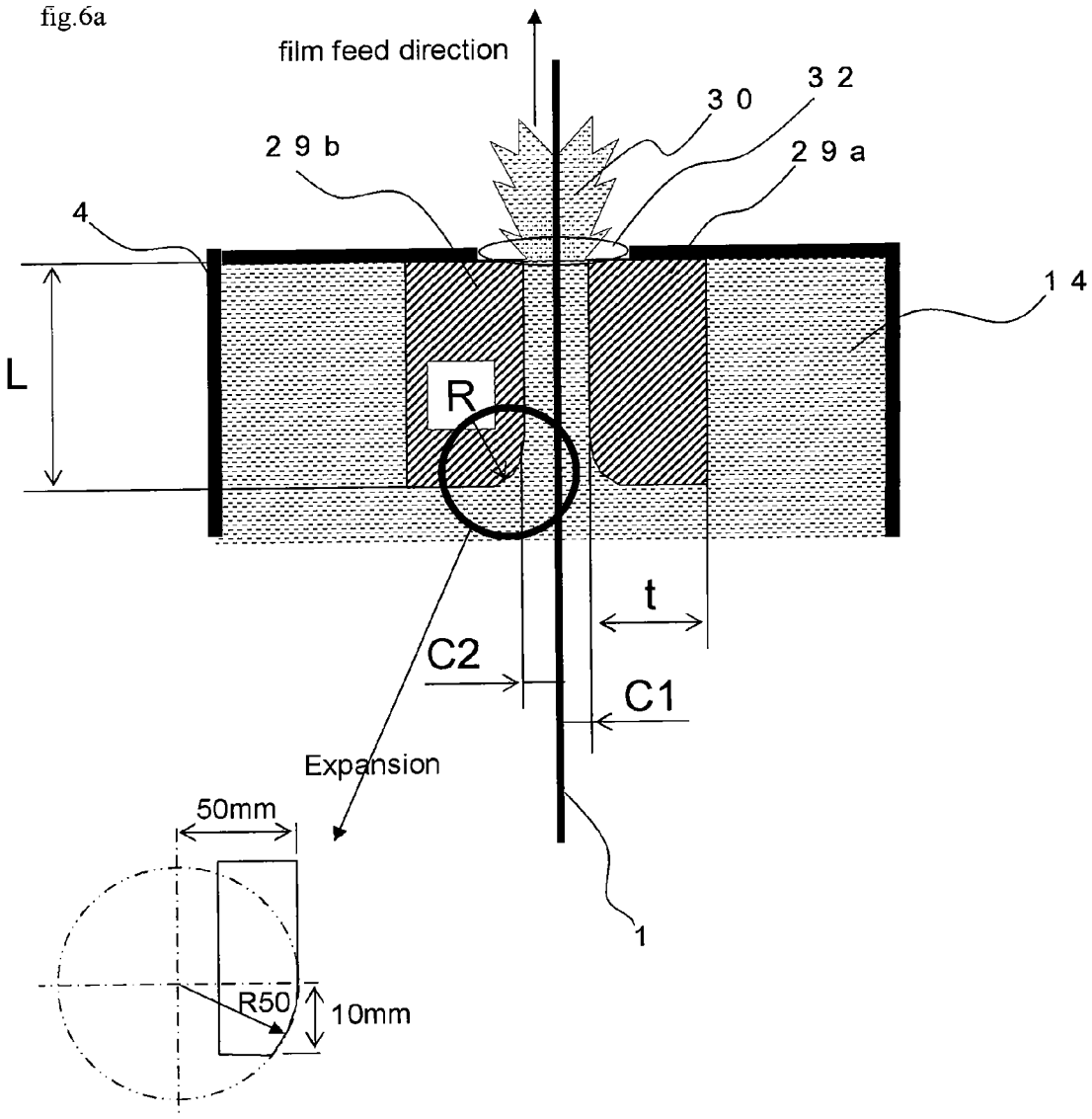
FIG. 6*a* is a schematic diagram showing the liquid sealing unit of FIG. 5 in an enlarged manner.
Figure 7:
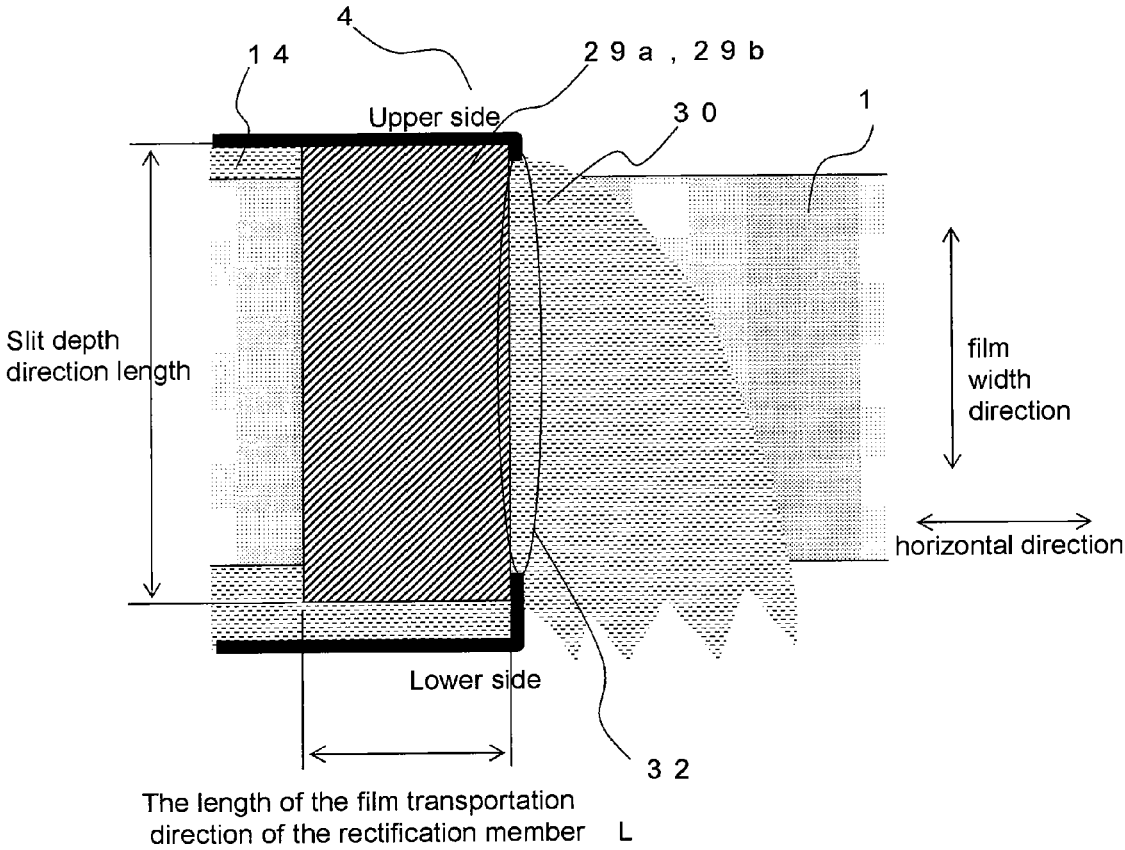
FIG. 7 is a schematic side view showing a case where a liquid sealing unit according to an embodiment of the invention is used in a vertically-oriented feed type plating tank.

FIG. 6*a* is a schematic diagram showing the liquid sealing unit 7 of FIG. 5 in an enlarged scale. The liquid sealing unit 7 is structured to include flow control members 29*a* and 29*b* that are opposed to each other to hold a film 1 feed path therebetween at the inlet or outlet of the plating tank 4 holding the plating liquid 14. A material resistant to the plating liquid is preferably used to form the flow control members 29*a* and 29*b*. For example, when a copper sulfate plating bath is used, polyvinyl chloride or a polyester resin is preferably used. In FIG. 6*a*, the flow control members 29*a* and 29*b* are placed inside the plating tank 4. Alternatively, they may be placed outside the plating tank 4. FIG. 7 is a schematic side view showing a case where the liquid sealing unit according to an embodiment of the invention is used in a vertically-oriented feed type plating tank. As shown in FIG. 7, the length of each of the flow control members 29*a* and 29*b* in the depth direction is preferably equal to or longer than the length of the opening 32 in the depth direction, in which the opening 32 is provided in the side wall of the plating tank 4 to serve as a film inlet or outlet. The upper surface of the flow control member 29*a* or 29*b* is preferably, but not limited to, formed at a level substantially equal to the level of the plating liquid surface. The upper surface of the flow control member 29*a* or 29*b* may be below or above the liquid surface.

As shown in FIG. 6*a*, the film 1 is placed at a distance of C1 from the flow control member 29*a* and at a distance of C2 from the flow control member 29*b* and fed between the flow control members 29*a* and 29*b* in non-contact therewith. The plating liquid 14 leaks along the film 1 between the flow control member 29*a* and the film 1 (namely, from the space of C1) and between the flow control member 29*b* and the film 1 (namely, from the space of C2), respectively (a treatment liquid 30 leaking from the liquid sealing unit). In order to stabilize the liquid flows between the film 1 and the flow control member 29*a*, the film 1 and the flow control member 29*b*, respectively, the film 1-side surfaces of the flow control members 29*a* and 29*b* are preferably flat surfaces parallel to each other. At this time, the amount of leakage of the treatment liquid 30 can be theoretically calculated from formula 2:

$$Q = \int_{H_1}^{H_2}\left(\frac{\rho \times g \times C\ 1^3}{12 \times \eta \times L}h\right)dh + \int_{H_1}^{H_2}\left(\frac{\rho \times g \times C\ 2^3}{12 \times \eta \times L}h\right)dh$$

Q: flow rate ($m^3$/sec)
ρ: treatment liquid density (kg/$m^3$)
η: treatment liquid viscosity (Pa·sec)
g: gravitational acceleration (m/$sec^2$)
C1: distance (m) between flow control member 29*a* and film 1
C2: distance (m) between flow control member 29*b* and film 1
L: wall surface length in web feed direction
$H_1$: distance (m) from upper end of slit to liquid surface
$H_2$: distance (m) from lower end of slit to liquid surface Now, a description is given of a mechanism for stable non-contact feeding between the flow control members 29*a* and 29*b*. When C1 (between the flow control member 29*a* and the film 1) is equal to C2 (between the flow control member 29*b* and the film 1) in the feeding of the film, the same pressure acts on both sides of the film 1, so that the film 1 can be fed in a stable state. When a certain external force acts on the film 1 so that the film 1 deviates to the flow control member 29*a* side from the stable state of C1=C2, the flow channel on the C2 side becomes wider (C1<C2), so that the channel resistance between the flow control member 29*b* and the film 1 (C2) decreases, which leads to a reduction in pressure. As a result, the film 1 is sucked toward the flow control member 29*b* side, and a force acts to restore it to the original position. On the other hand, when the film 1 deviates to the flow control member 29*b* side, a force acts to move it toward the flow control member 29*a* side. Such a mechanism makes it possible to stably feed the film 1 in such a state that the film 1 is less likely to come into contact with the flow control member 29*a* or 29*b*. To allow the mechanism to act effectively, it is preferred that the object to be fed should be thin and light. Therefore, the web preferably has a thickness of 10 μm to 100 μm, and a plastic film is particularly preferred, because it is light and flexible so that the action can be effective. The feed tension of the web is preferably from 50 N/m to 500 N/m. This is because if it is less than 50 N/m, the web may be fluttered by the liquid flow leaking from the liquid sealing unit, and if it is more than 500 m/N, an effect as if the stiffness of the web is increased may be produced, so that the above mechanism may not effectively work.

The gap C1+C2 between the flow control members 29*a* and 29*b* (specifically, the distance in the normal direction between the surfaces of the film feed path between the film-side wall surfaces of the flow control members 29*a* and 29*b*) is preferably 10 mm or less in order to reduce the amount of leakage of the treatment liquid 30. However, if it is too small, the film can easily come into contact with the flow control member 29*a* or 29*b* or the like, and therefore, it is preferably 0.25 mm or more. The treatment liquid 30 leaks along the film 1. Therefore, if the amount of the leakage is too large, a collecting zone 16 as shown in FIG. 5 should have a long length in the film feed direction. Therefore, the gap C1+C2 between the flow control members 29*a* and 29*b* is more preferably set in the range of 1 mm to 3 mm so that the length of the collecting zone 16 in the film feed direction can be short and that the film 1 can be prevented from contact and fed stably.

Figure 6B:
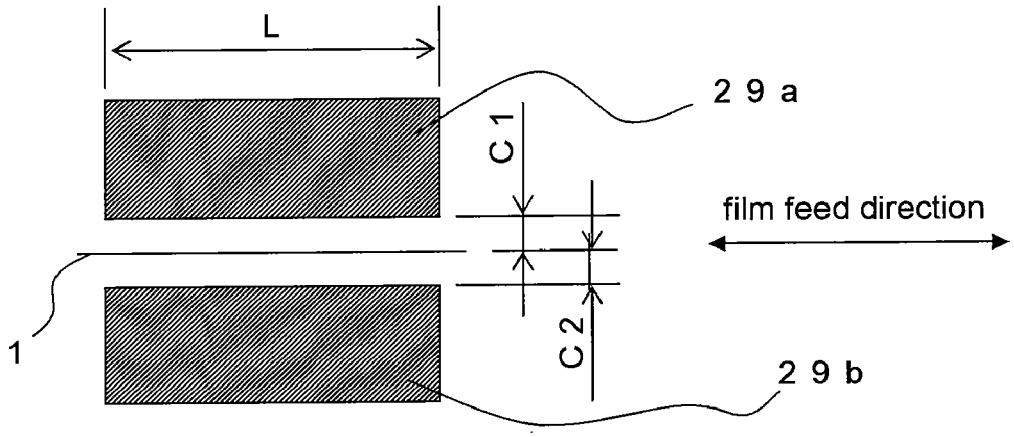
FIG. 6*b* is a schematic diagram of an example of the wall surface form (parallel flat surfaces)
Figure 6C:
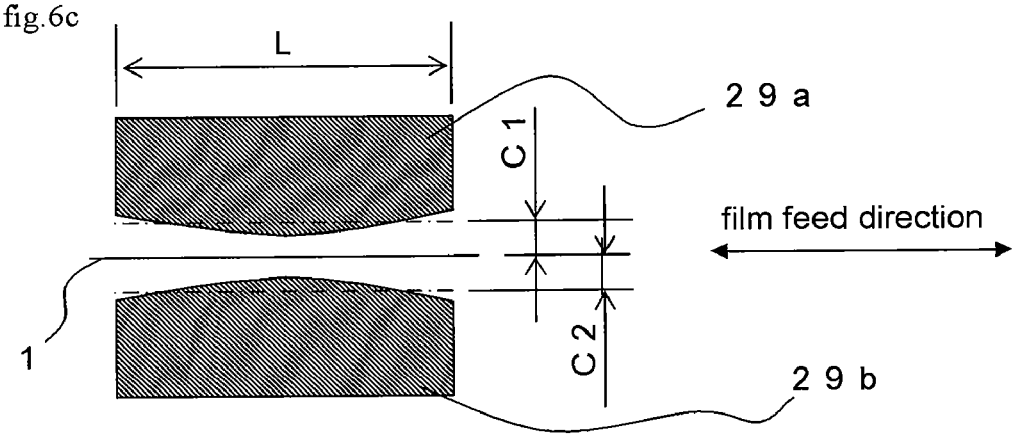
FIG. 6*c* is a schematic diagram of another example of the wall surface form (curved surfaces)
Figure 6D:
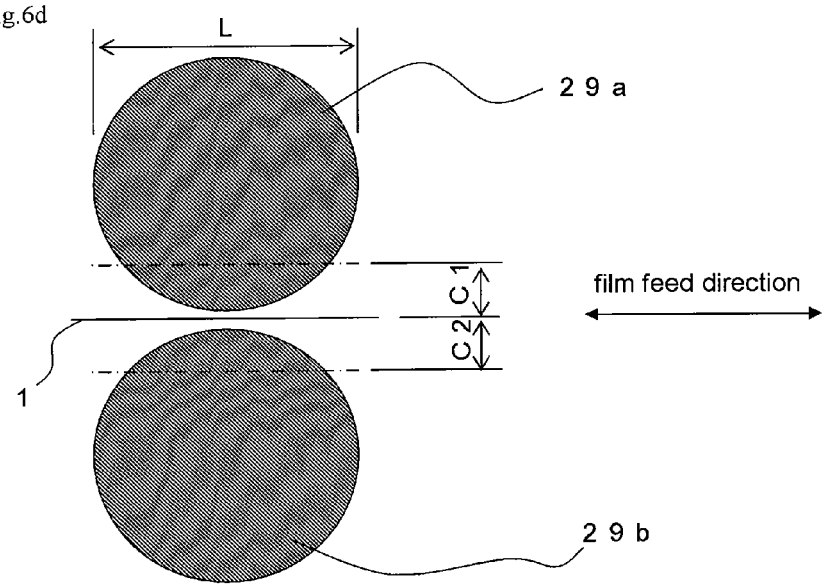
FIG. 6*d* is a schematic diagram of a further example of the wall surface form (cylinders)

The wall surface of the flow control member may be a flat or curved surface. In the case of a curved surface, the gap C1+C2 between the flow control members 29*a* and 29*b* may be approximated by the average gap over the film feed direction. FIGS. 6*b*, 6*c* and 6*d* each show an example of the wall surface shape. In the case of two parallel flat surfaces as shown in FIG. 6*b*, C1+C2 corresponds to the gap itself between the parallel flat surfaces. In the case of curved surfaces as shown in FIG. 6*c*, C1+C2 varies with the position along the film feed direction. In this case, the C1+C2 average over the film feed direction as mentioned above may be determined by dividing the length L of the wall surface in the web feed direction into 20 equal parts and averaging the C1+C2 values at the 20 points. In the case of two circular cylinders arranged as shown in FIG. 6*d*, C1+C2 also varies with the position along the film feed direction, and therefore, the average over the film feed direction should be calculated. In this case, it should be noted that if the outer diameter of the cylinder is changed so that C1+C2 can be changed, the length L of the wall surface in the web feed direction is also changed at the same time. Basically, the flow rate can be decreased with increasing L, although the role and expected effect of L are described in detail later. However, when L is increased so that the flow rate can be reduced, C1+C2 is automatically increased. Since the flow rate can be decreased with decreasing C1+C2, the components have a trade-off relationship and are very difficult to optimize. In carrying out the invention, therefore, it should be avoided to arrange two circular cylinders as shown in FIG. 6*d*.

Figure 6E:
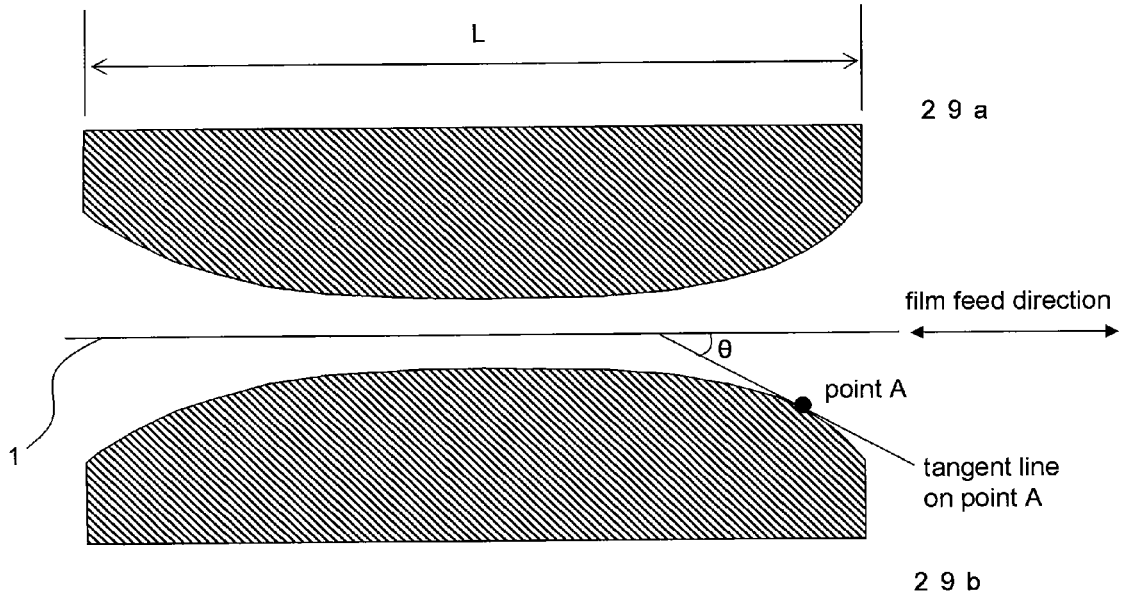
FIG. 6*e* is a diagram for illustrating the angle between the tangent line of a curved wall surface line and the film feed direction.

In order to reduce the flow rate, the tangent line of the wall surface curve preferably makes an angle of −20° to 20° with the web feed direction in 40% or more of the entire wall surface (when the tangent line is parallel to the web feed direction, the angle is assumed to be 0° (see FIG. 6*e*, which is a diagram illustrating the angle between the tangent line of the wall surface curve and the film feed direction). More preferably, the tangent line of the wall surface curve makes an angle of −20° to 20° with the web feed direction in more than 70% of the entire wall surface, so that the wall surface can have a very smooth shape and stabilize the liquid flow.

In this context, the wall surface curve represents a macroscopic profile of the wall surface and is not intended to include a microscopic curve such as a so-called roughness curve.

Liquid flows between the film 1 and the flow control member 29*a* and between the film 1 and the flow control member 29*b* have the function of preventing the film 1 from coming into contact with the flow control member 29*a* or 29*b*. Therefore, the amount of leakage of the treatment liquid 30 is preferably 5 L/minute or more. If the amount of leakage is too large, it may be necessary to increase the power of the pump for circulating the plating liquid 14 or to increase the volume of the storage tank for storing the plating liquid 14. In order to keep them in an appropriate range, the amount of leakage of the treatment liquid is preferably 300 L/minute or less.

The structure of the liquid sealing unit 7 according to this embodiment is preferably used in a vertically-oriented feed type plating tank. In order to reduce the amount of leakage of the treatment liquid 30, the length L of the flow control member 29*a* or 29*b* in the film feed direction as shown in FIG. 7 is preferably 5% or more of the length of the slit in the depth direction formed by the flow control members 29*a* and 29*b*. This is because as expressed by formula 2, when the type of the treatment liquid 30, the gap C1+C2 between the flow control members 29*a* and 29*b*, the distance H1 from the upper end of the slit to the liquid surface, and the distance H2 from the lower end of the slit to the liquid surface are determined, an increase in the length L of the flow control member 29*a* or 29*b* in the film feed direction causes a pressure loss on the wall surface of the flow control member 29*a* or 29*b*, so that the amount of leakage of the treatment liquid 30 from the plating tank 4 decreases. If the length L of the flow control member 29*a* or 29*b* in the film feed direction is too long, the risk of contact of the film 1 with the flow control member 29*a* or 29*b* will be high. According to formula 2 from which the amount of the leakage can be calculated, the effect of reducing the amount of the leakage becomes small, when the length L in the film feed direction reaches or exceeds a certain level. Therefore, the length L is preferably 100% or less, more preferably 70% or less, even more preferably 50% or less of the length of the slit, taking into account the balance between the effect of reducing the leakage amount and the risk of the contact. The effect of reducing the leakage amount is particularly significant in a wide-web treatment tank with a slit long in the depth direction. In particular, therefore, a treatment tank for a web with a width of more than 300 mm is preferably used.

Figure 8:
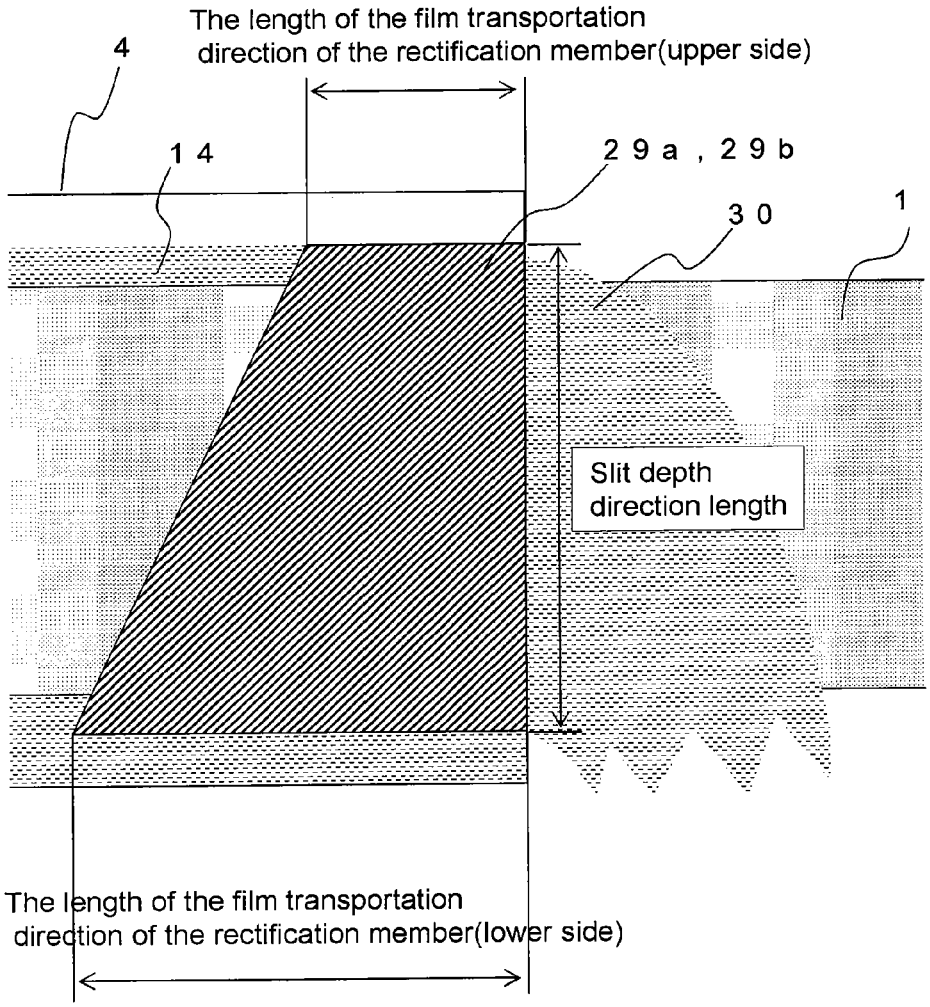
FIG. 8 is a schematic side view showing a case where a liquid sealing unit according to an embodiment of the invention is used in a vertically-oriented feed type plating tank.

When the film-side wall surfaces of the flow control members 29*a* and 29*b* are parallel to each other, the amount of leakage of the treatment liquid 30 is relatively small on the upper side of the plating tank and relatively large on the lower side. This is because the pressure of the treatment liquid 30 in the plating tank 4 varies with the position due to the water head difference. On the upper side of the plating tank, the water head pressure is relatively low so that the treatment liquid leaks from the gap at a relatively low flow rate. On the lower side of the plating tank, the water head pressure is relatively high so that the treatment liquid leaks from the gap at a relatively high flow rate. As shown in FIG. 8, therefore, the length L of the flow control member 29*a* or 29*b* in the film feed direction is preferably made longer on the lower side than on the upper side, as needed, depending on the ratio between the distance from the liquid surface to the upper end of the slit and the distance from the liquid surface to the lower end of the slit. FIG. 8 is a schematic side view showing a case where a liquid sealing unit according to an embodiment of the invention is used in a vertically-oriented feed type plating tank. This structure can reduce the variations in the flow rate of the treatment liquid leaking from the gap between the flow control members 29*a* and 29*b*, which would otherwise vary in the depth direction of the slit formed at the flow control members 29*a* and 29*b*. As a result, the effect of stabilizing the position of the film being fed can easily become constant, regardless of the position in the thickness direction, so that the film can be stably fed without coming into contact with the wall surfaces of the flow control members 29*a* and 29*b* over the entire width of the film.

Figure 9:
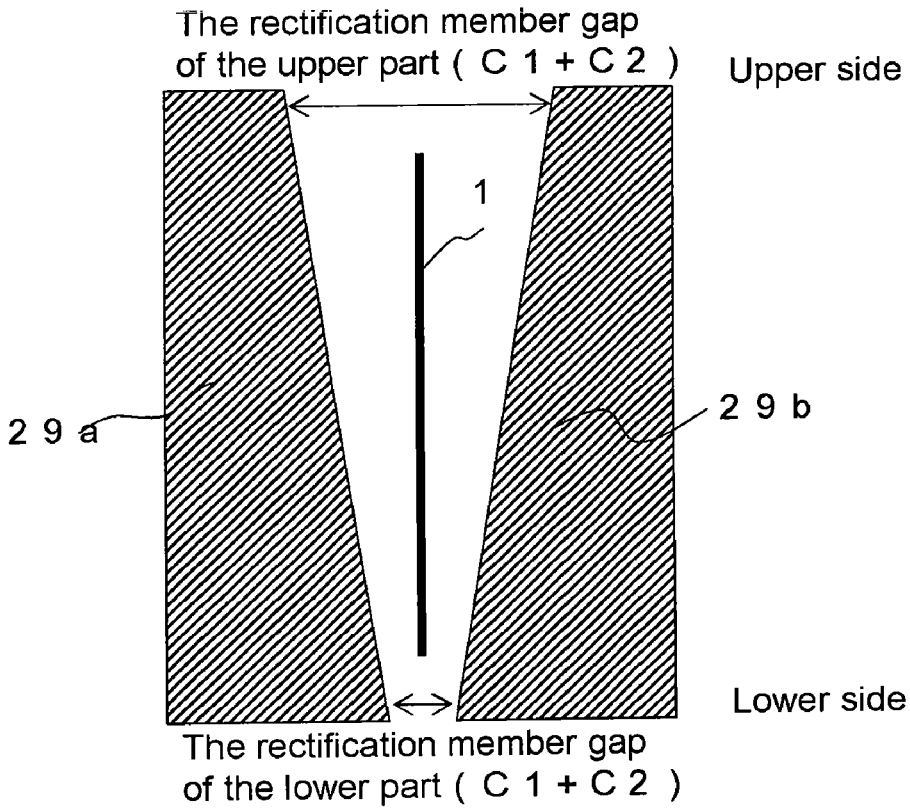
FIG. 9 is a schematic front view showing a case where a liquid sealing unit according to an embodiment of the invention is used in a vertically-oriented feed type plating tank.

In addition, as shown in FIG. 9, the gap C1+C2 between the flow control members 29*a* and 29*b* is preferably made smaller on the lower side than on the upper side. FIG. 9 is a schematic front view showing a case where a liquid sealing unit according to an embodiment of the invention is used in a vertically-oriented feed type plating tank. This structure can reduce the variations in the flow rate of the treatment liquid leaking from the gap between the flow control members 29*a* and 29*b*, which would otherwise vary in the depth direction of the slit formed at the flow control members 29*a* and 29*b*, so that the film can be stably fed without coming into contact with the wall surfaces of the flow control members 29*a* and 29*b*. Finally, the ratio of the maximum $C^3 \times H/L$ value in the depth direction to the minimum $C^3 \times H/L$ value in the depth direction is preferably 8 (times) or less.

When the flow control members 29*a* and 29*b* are structured as described above, the opening that is formed in the side wall of the plating tank 4 to serve as an inlet or outlet for the film may have a shape matching the shape of a slit formed by the wall surfaces of the flow control members 29*a* and 29*b* on the film feed path side or may have a shape larger than the shape of the slit but not larger than the surface of the flow control member 29*a* or 29*b* on the plating tank 4 side. The lower end of the opening is formed to fit the lower ends of the flow control members 29*a* and 29*b*.

The flow control members 29*a* and 29*b* may bend, when they undergo a difference in pressure between the inside and outside of the slit. As expressed by formula 1, the amount of leakage from the slit is proportional to the cube of the slit gap, and therefore, a small deformation may produce a large difference in the leakage amount. Thus, it is preferred that the thickness t of the member should be increased so that the bending can be as small as possible. In a preferred mode, the gap is slightly widened in an area 5 to 20 mm from each of the film 1-side corners of the plating tank inside end portions of the flow control members 29*a* and 29*b* so that the film 1 can be prevented from coming into contact with the flow control member 29*a* or 29*b* even when the film 1 is significantly fluttered by the liquid flow in the tank. If it is too wide, the flow channel resistance may be reduced to increase the amount of leakage, or the liquid flow may become unstable. Therefore, a curved surface with a radius of curvature of 10 mm to 100 mm is preferably formed. Strictly speaking, the slit gap is widened at the portions having curved surfaces. In the above curvature range, however, the wall surface having a length L in the film feed direction may include the curved surface portion as shown in FIG. 6*a*.

The plating tank according to this embodiment is preferably used in an apparatus for continuous electroplating on a plastic film, so that fine scratches, surface irregularities and so on can be prevented and that maintenance-free operation of a nip roll-type or contact rotary seal-type apparatus can be performed, which makes it possible to reduce the running cost. In particular, the plating tank according to this embodiment is preferably used in applications requiring high quality and low cost at the same time, such as the production of flexible circuit board materials.

While an embodiment has been described using an exemplary case where the treatment tank is used in a vertically-oriented feed type apparatus for continuous copper electroplating on a polyimide film, the treatment tank may also be used in other applications such as all types of tanks for wet treatment of webs including web cleaning tanks and electroless plating tanks.

EXAMPLES

The invention is further described in detail below by specific examples, which are not intended to limit the scope of the invention.

Example 1

Liquid sealing units each having the structure shown in FIGS. 6*a* and 7 were provided inside a vertically-oriented feed type plating tank. Specifically, each liquid sealing unit provided includes flow control members 29*a* and 29*b* which have wall surfaces parallel to each other and each have the same length L in the film feed direction as the length in the slit depth direction. The flow control members 29*a* and 29*b* were each made of hard polyvinyl chloride. The gap C1+C2 between the flow control members 29*a* and 29*b* was 2 mm. The length L of each of the flow control members 29*a* and 29*b* was 75 mm in the film feed direction. The thickness t of each of the flow control members 29*a* and 29*b* was 30 mm. The slit length in the depth direction was 600 mm (the length L of each of the flow control members 29*a* and 29*b* in the film feed direction is 12.5% of the slit length in the depth direction). As shown in FIG. 6*a*, a curved surface was formed at each of the inside end portions of the flow control members 29*a* and 29*b* in the plating tank. The curved surface was in the form of a circular arc with a radius of 50 mm, of which the center was located 50 mm apart from the film-side surface of the flow control member to the side opposite to the base material in the lateral direction in the drawing and 10 mm offset from the lower end of the flow control member in the vertical direction in the drawing.

City water was placed in the plating tank structured as describe above, and liquid leakage was checked. The pump discharge amount required to keep constant the liquid level in the plating tank was measured with a float type flow meter placed in the piping of the circulating system. The distance from the liquid surface to the upper end of the slit below the liquid surface is 50 mm. The distance from the liquid surface to the lower end of the slit is 650 mm. The slit length in the depth direction is 700 mm. A 38 μm thick, 520 mm wide polyimide film with one side coated with 0.1 μm thick copper by sputtering was used. As a result, the amount of leakage was found to be about 100 L/minute per one liquid sealing unit.

The above structure was used in a vertically-oriented feed type continuous copper electroplating apparatus, and an experiment was performed on the production of a copper-film-plated polyimide film. The plating apparatus had 10 plating tanks, each of which was provided with liquid sealing units on the inlet and outlet sides, respectively (20 units in total). A roll of a 38 μm thick, 520 mm wide polyimide film with one side coated with a 0.1 μm thick copper film by sputtering was used. The tension was set in a gradually increasing manner so that it could be 40 N/full-width at the inlet of the first plating tank and 190 N/full-width at the outlet of the last plating tank. The current density was appropriately selected so that the copper film output from the last plating tank could have a thickness of 8.5 μm. These conditions are substantially the same as those used in the case where a nip roll-type contact rotary seal (a conventional technique) is used in the liquid sealing unit (see Comparative Example 1). As a result of the production of the copper-film-plated polyimide film described above, a high-quality plating film with very few scratches and surface irregularities was obtained.

The conditions and results are summarized in Table 1.

TABLE 1

| Experimental Condition | L length [mm] | upper side C1 + C2[mm]/ lower side C1 + C2[mm] | Appearance quality | Quantity of leak [L/min] |
|---|---|---|---|---|
| Example 1 | 75 | 2/2 | ○ | 100 |
| Example 2 | 75 | 3/3 | ○ | 180 |
| Example 3 | 75 | 3/2 | ○ | 130 |
| Example 4 | 45 | 3/2 | ○ | 170 |
| Example 5 | 75 | 20/20 | ○ | too much |
| Example 6 | 75 | 0.1/0.1 | Δ | too little |
| Comparative Example 1 | 0 (roll) | 0/0 (nipped) | x | too little |
| Comparative Example 2 | 10 | 2/2 | Experiment failed | too much |
| Comparative Example 3 | 10 | 0.4/0.4 | Δ | 180 |
| Comparative Example 4 | 0 (shaft) | 2/2 | Δ | 200 |

Example 2

An experiment was performed as in Example 1, except that the gap C1+C2 between the flow control members 29*a* and 29*b* was changed to 3 mm in the plating tank of Example 1.

The amount of leakage was about 180 L/minute per one liquid sealing unit.

A plating experiment was also performed in the same way as in Example 1. As a result, a high-quality plating film with very few scratches and surface irregularities was obtained. The conditions and results are summarized in Table 1.

Example 3

An experiment was performed as in Example 1, except that in the plating tank of Example 1, the gap C1+C2 between the flow control members 29*a* and 29*b* was set to 3 mm and 2 mm on the upper and lower sides, respectively, and the gap was changed with a constant gradient in the middle portion.

The amount of leakage was about 130 L/minute per one liquid sealing unit.

A plating experiment was also performed in the same way as in Example 1. As a result, a high-quality plating film with very few scratches and surface irregularities was obtained. The conditions and results are summarized in Table 1.

Example 4

An experiment was performed as in Example 1, except that in the plating tank of Example 1, the gap C1+C2 between the flow control members 29*a* and 29*b* was set to 3 mm and 2 mm on the upper and lower sides, respectively, the gap was changed with a constant gradient in the middle portion, and the length L of each flow control member in the feed direction was changed to 45 mm (the length L of the flow control member in the film feed direction was 7.5% of the slit length in the depth direction).

The amount of leakage was about 170 L/minute per one liquid sealing unit.

A plating experiment was also performed in the same way as in Example 1. As a result, a high-quality plating film with very few scratches and surface irregularities was obtained. The conditions and results are summarized in Table 1.

Example 5

In the plating tank having the structure of Example 1, the gap C1+C2 between the flow control members 29*a* and 29*b* was changed to 20 mm. As a result, a high-quality plating film with very few scratches and surface irregularities was obtained. However, the amount of liquid leakage from the slit was too large, so that the apparatus needed a high pump power. The conditions and results are summarized in Table 1.

Example 6

In the plating tank having the structure of Example 1, the gap C1+C2 between the flow control members 29*a* and 29*b* was changed to 0.1 mm, and an experiment was performed on the production of a copper-film-plated polyimide film as in Example 1. As a result, the amount of liquid leakage from the slit was reduced, but some scratches were formed. The conditions and results are summarized in Table 1.

Comparative Example 1

Figure 4:
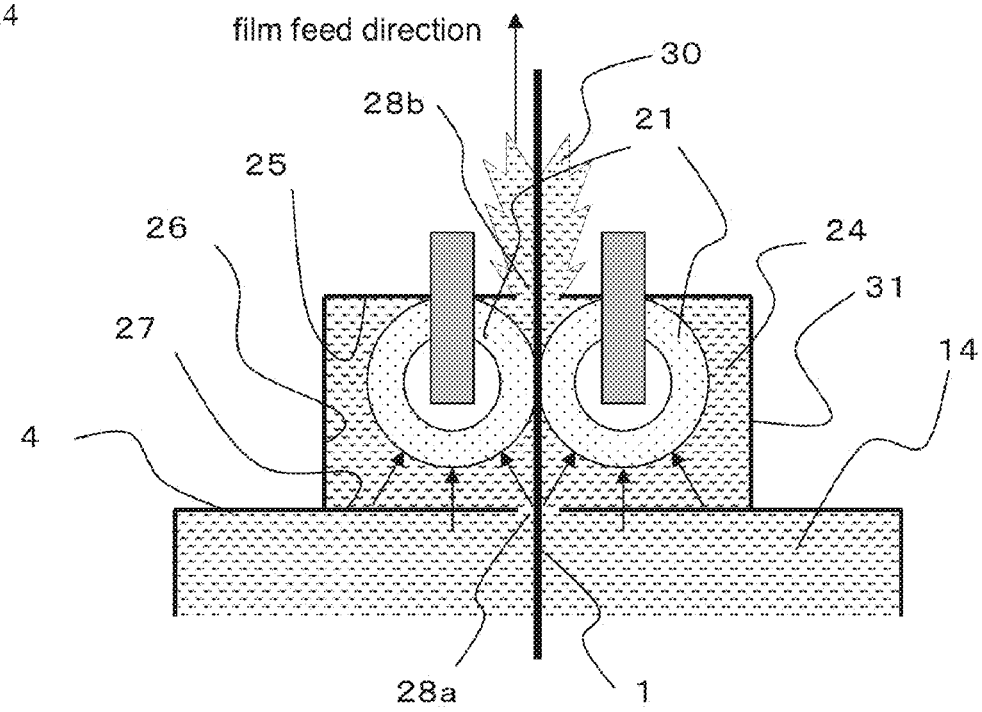
FIG. 4 is a schematic diagram of a liquid sealing unit for use in a conventional technique.

In the plating tank having the structure of Example 1, each liquid sealing unit was replaced with the structure shown in FIG. 4. Polyvinyl chloride was used to form the spongy roll 21. The roll had a diameter of 40 mm, and the distance between the axes of the two rolls was set to 38 mm, so that a nipping structure was formed.

The resulting structure was used in a vertically-oriented feed type continuous copper electroplating apparatus, and an experiment was performed on the production of a copper-film-plated polyimide film as in Example 1. As a result, fine scratches were observed on the surface. When the surface of the spongy roll used was stained, the stain was transferred to the plating film, and fine surface irregularities and scratches were also observed. As a result, it was very difficult to obtain a high-quality plating film. The conditions and results are summarized in Table 1.

Comparative Example 2

In the plating tank having the structure of Example 1, the length L of each of the flow control members 29*a* and 29*b* in the film feed direction was changed to 10 mm (the length L of the flow control member in the film feed direction was about 1.7% of the slit length in the depth direction). As a result, the amount of leakage from the slit was too large, so that the apparatus needed a high pump power. In addition, since the amount of liquid leakage from the slit was large and the flow rate was high, significant fluttering of the film was observed immediately outside the plating tank, which showed unstable feeding. The conditions and results are summarized in Table 1.

Comparative Example 3

In the plating tank having the structure of Example 1, the length L of each of the flow control members 29*a* and 29*b* in the film feed direction was set to 10 mm, and the gap C1+C2 between the flow control members 29*a* and 29*b* was set to 0.4 mm.

City water was placed in the plating tank structured as describe above, and liquid leakage was checked. The pump discharge amount required to keep constant the liquid level in the plating tank was measured with a float type flow meter placed in the piping of the circulating system. The distance from the liquid surface to the upper end of the slit was 50 mm, and the distance from the liquid surface to the lower end of the slit was 650 mm. A 38 μm thick, 520 mm wide polyimide film with one side coated with 0.1 μm thick copper by sputtering was used. As a result, the amount of liquid leakage was found to be about 180 L/minute per one liquid sealing unit.

The resulting structure was used in a vertically-oriented feed type continuous copper electroplating apparatus, and an experiment was performed on the production of a copper-film-plated polyimide film as in Example 1. As a result, scratches were observed on the surface. Fluttering of the film was also observed immediately outside the plating tank, which showed unstable feeding. The conditions and results are summarized in Table 1.

Comparative Example 4

In the plating tank having the structure of Example 1, a round bar with a diameter of 30 mm was used in place of each of the flow control members 29*a* and 29*b*, and the gap between the round bars was set to 2 mm. In this case, the length corresponding to the length L of each of the flow control members 29*a* and 29*b* in the film feed direction is zero.

City water was placed in the plating tank structured as describe above, and liquid leakage was checked. The pump discharge amount required to keep constant the liquid level in the plating tank was measured with a float type flow meter placed in the piping of the circulating system. The distance from the liquid surface to the upper end of the slit was 50 mm, and the distance from the liquid surface to the lower end of the slit was 650 mm. A 38 μm thick, 520 mm wide polyimide film with one side coated with 0.1 μm thick copper by sputtering was used. As a result, the amount of liquid leakage was found to be about 200 L/minute per one liquid sealing unit.

The resulting structure was used in a vertically-oriented feed type continuous copper electroplating apparatus, and an experiment was performed on the production of a copper-film-plated polyimide film as in Example 1. As a result, scratches were observed on the surface. Fluttering of the film was also observed immediately outside the plating tank, which showed unstable feeding. The conditions and results are summarized in Table 1.

In the structure according to embodiments of the invention, the web can be stably fed in a non-contact manner. Therefore, it is suitable for use in an apparatus for continuous electroplating on a plastic film, which is used as a flexible circuit board material suitably made of a very flexible web and to have extremely high surface quality. However, it is applicable not only to such an apparatus for continuous electroplating on a plastic film but also to all types of apparatuses for treating a web with a liquid chemical, such as other apparatuses for continuous electroplating on a web and electrolytic treatment apparatuses, but its application range is not restricted thereto.

The invention claimed is:

1. A web treatment tank, which is used in a vertically-oriented feed type, comprising:

a side wall;

an opening provided in the side wall; and a liquid sealing unit that is provided at the side wall to control leakage of a treatment liquid from the opening, the liquid sealing unit comprising a pair of wall surfaces spaced apart from each other with a predetermined gap therebetween and opposed to each other with a web feed path interposed therebetween, the gap being configured to allow the web to pass continuously in non-contact through the liquid sealing unit, the pair of wall surfaces each having a length in the direction of feed of the web, the length of each wall surface being from 5% to 100% of the length of a slit in the direction of the depth of the treatment tank, the slit being formed by the pair of wall surfaces, wherein the gap between the wall surfaces has a top end and a bottom end, and the gap is narrower at the bottom end than at the top end.

2. A web treatment tank, which is used in a vertically-oriented feed type, comprising:

a side wall;

an opening provided in the side wall; and a liquid sealing unit that is provided at the side wall to control leakage of a treatment liquid from the opening, the liquid sealing unit comprising a pair of wall surfaces spaced apart from each other with a predetermined gap therebetween and opposed to each other with a web feed path interposed therebetween, the gap being configured to allow the web to pass continuously in non-contact through the liquid sealing unit, the pair of wall surfaces each having a length in the direction of feed of the web, the length of each wall surface being from 5% to 100% of the length of a slit in the direction of the depth of the treatment tank, the slit being formed by the pair of wall surfaces, wherein the pair of wall surfaces have a lower side and an upper side, and the length of each wall surface in the direction of feed of the web is longer on the lower side than on the upper side.

3. A web treatment tank, which is used in a vertically-oriented feed type, comprising:

a side wall;

an opening provided in the side wall; and a liquid sealing unit that is provided at the side wall to control leakage of a treatment liquid from the opening, the liquid sealing unit comprising a pair of wall surfaces spaced apart from each other with a predetermined gap therebetween, the wall surfaces being opposed to each other with a web feed path interposed therebetween and the gap having a top end and a bottom end, the pair of wall surfaces each having a length in the direction of feed of the web, the length of each wall surface being from 5% to 100% of the length of a slit in the direction of the depth of the treatment tank, the slit being formed by the pair of wall surfaces, wherein the gap between the wall surfaces is narrower at the bottom end than at the top end.

4. The web treatment tank according to claim 3, wherein the wall surfaces have a lower side and an upper side and the length of each wall surface in the direction of feed of the web is longer on the lower side than on the upper side.

5. A web treatment tank, which is used in a vertically-oriented feed type, comprising:

a side wall;

an opening provided in the side wall; and a liquid sealing unit that is provided at the side wall to control leakage of a treatment liquid from the opening, the liquid sealing unit comprising a pair of wall surfaces spaced apart from each other having a lower side and an upper side with a predetermined gap therebetween, the wall surfaces being opposed to each other with a web feed path interposed therebetween, the pair of wall surfaces each having a length in the direction of feed of the web, the length of each wall surface being from 5% to 100% of the length of a slit in the direction of the depth of the treatment tank, the slit being formed by the pair of wall surfaces, and wherein the length of each wall surface in the direction of feed of the web is longer on the lower side than on the upper side.

* * * * *